US011631555B2

(12) United States Patent
Horiuchi et al.

(10) Patent No.: US 11,631,555 B2
(45) Date of Patent: Apr. 18, 2023

(54) KEYBOARD DEVICE

(71) Applicant: Chicony Electronics Co., Ltd., New Taipei (TW)

(72) Inventors: Mitsuo Horiuchi, New Taipei (TW); He-Kai Zhang, New Taipei (TW); Chih-Hao Chen, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/549,405

(22) Filed: Dec. 13, 2021

(65) Prior Publication Data

US 2022/0254582 A1 Aug. 11, 2022

(30) Foreign Application Priority Data

Feb. 8, 2021 (TW) ..... 110104826

(51) Int. Cl.
*H01H 13/14* (2006.01)
*H01H 13/7065* (2006.01)
*H01H 3/12* (2006.01)

(52) U.S. Cl.
CPC ..... *H01H 13/14* (2013.01); *H01H 3/122* (2013.01); *H01H 13/7065* (2013.01)

(58) Field of Classification Search
CPC .... H01H 13/14; H01H 13/70; H01H 13/7006; H01H 13/7013; H01H 13/702; H01H 13/703; H01H 13/705; H01H 13/7065; H01H 3/12; H01H 3/122; H01H 3/00; H01H 3/02; H01H 5/00; H01H 5/04; H01H 13/50; H01H 13/52; H01H 2003/12; H01H 2221/00
See application file for complete search history.

(56) References Cited

U.S. PATENT DOCUMENTS 6,091,036 A * 7/2000 Hu ..... H01H 3/125 200/344

FOREIGN PATENT DOCUMENTS

CN 107946114 A * 4/2018 ..... H01H 13/705
TW M484179 U 8/2014

* cited by examiner

*Primary Examiner* — Anthony R Jimenez
(74) *Attorney, Agent, or Firm* — Muncy, Geissler, Olds & Lowe, P.C.

(57) ABSTRACT

A keyboard device includes a substrate, a keycap on the substrate, a first link member connected between the substrate and the keycap and is adjacent to the first side portion of the keycap, and a second link member connected between the substrate and the keycap and is adjacent to the second side portion of the keycap. The two first short swing arms of the first link member are respectively connected to two ends of the first pivot arm of the first link member. A length of each first short swing arm is less than half of a length of the first pivot arm. The two second short swing arms of the second link member are respectively connected to two ends of the second pivot arm of the second link member. A length of each second short swing arm is less than half of a length of the second pivot arm.

11 Claims, 6 Drawing Sheets

KEYBOARD DEVICE

CROSS-REFERENCE TO RELATED APPLICATION

This non-provisional application claims priority under 35 U.S.C. § 119(a) to Patent Application No. 110104826 filed in Taiwan, R.O.C. on Feb. 8, 2021, the entire contents of which are hereby incorporated by reference.

BACKGROUND

Technical Field

The instant disclosure relates to an input device, in particular, to a keyboard device.

Related Art

Keyboards are common input devices. Usually, they are used along with daily computer products (such as laptops, notebook computers, smart phones, or tablets), industrial scaled control equipment, or processing equipment for operation or text inputs.

SUMMARY

In general, a keyboard known to the inventor(s) includes a keycap, a scissor-type connection member, and a substrate. The scissor-type connection member is provided for being assembled between the keycap and the substrate for guiding the keycap to move up and down.

In general, the scissor-type connection member is formed by an outer frame and an inner frame, and the inner frame is pivotally connected to the inner portion of the outer frame. However, it is understood that, for manufacturing such scissor-type connection member, the inner frame and the outer frame are manually assembled with each other and then assembled to the keycap and the substrate. Furthermore, sizes of the outer frame and the inner frame are big, and the swing distance of the scissor-type connection member is long. As a result, the stroke of the scissor-type connection member is hard to estimate and predicted. Consequently, a keyboard with such scissor-type connection member cannot be designed easily.

In view of this, in one embodiment, a keyboard device is provided. The keyboard device comprises a substrate, a keycap, a first link member, and a second link member. The keycap is disposed on the substrate. The keycap comprises a first side portion, a second side portion, a third side portion, and a fourth side portion. The first side portion, the second side portion, the third side portion, and the fourth side portion are connected to one another. The first side portion is opposite to the second side portion. The third side portion is opposite to the fourth side portion. The first link member is connected between the substrate and the keycap. The first link member comprises a first pivot arm and two first short swing arms. The two first short swing arms are respectively connected to two ends of the first pivot arm. A length of each of the first short swing arms is less than half of a length of the first pivot arm. The first pivot arm is pivotally connected to a bottom portion of the first side portion of the keycap, and each of the first short swing arms is swingably connected to the substrate. The second link member is connected between the substrate and the keycap. The second link member comprises a second pivot arm and two second short swing arms. The two second short swing arms are respectively connected to two ends of the second pivot arm. A length of each of the second short swing arms is less than half of a length of the second pivot arm. The second pivot arm is pivotally connected to a bottom portion of the second side portion of the keycap, and each of the second short swing arms is swingably connected to the substrate.

Based on the above, in the keyboard device according to one or some embodiments of the instant disclosure, the first link member and the second link member are separated components and are respectively connected between the corresponding side portions of the keycap and the substrate. Therefore, the assembling steps and the labor costs for the keyboard device can be reduced. Moreover, the length of each of the first short swing arms is less than half of the length of the first pivot arm and the length of each of the second short swing arms is less than half of the length of the second pivot arm. Therefore, when the first link member and the second link member are applied to a key having a low keystroke (e.g., the up-down stroke of the key is about between 0.5 mm and 1.5 mm), the flatness of the keycaps can be prevented from being affected by the tolerance of the substrate.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
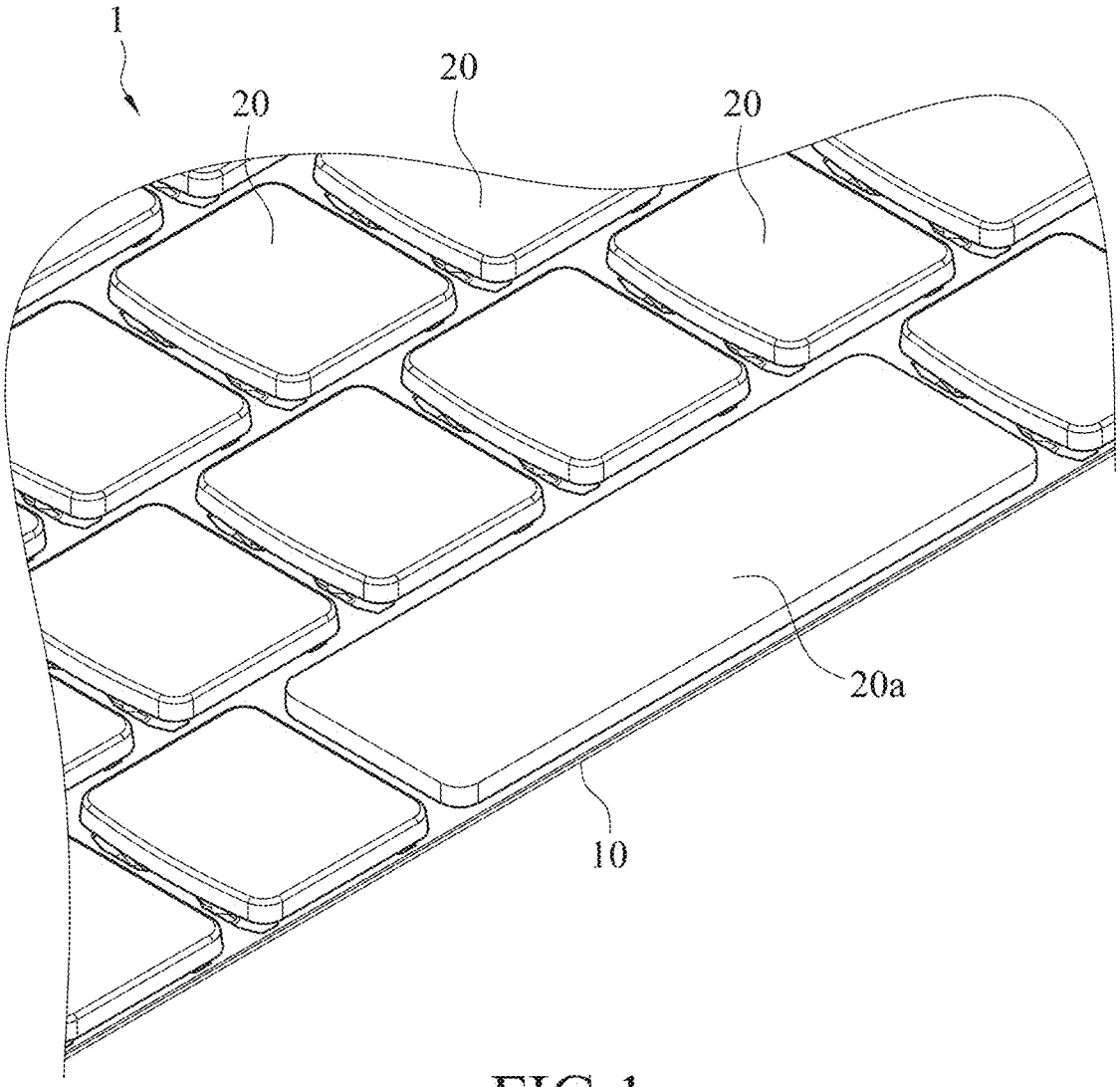
FIG. 1 illustrates a perspective view of a keyboard device according to an exemplary embodiment of the instant disclosure.
Figure 2:
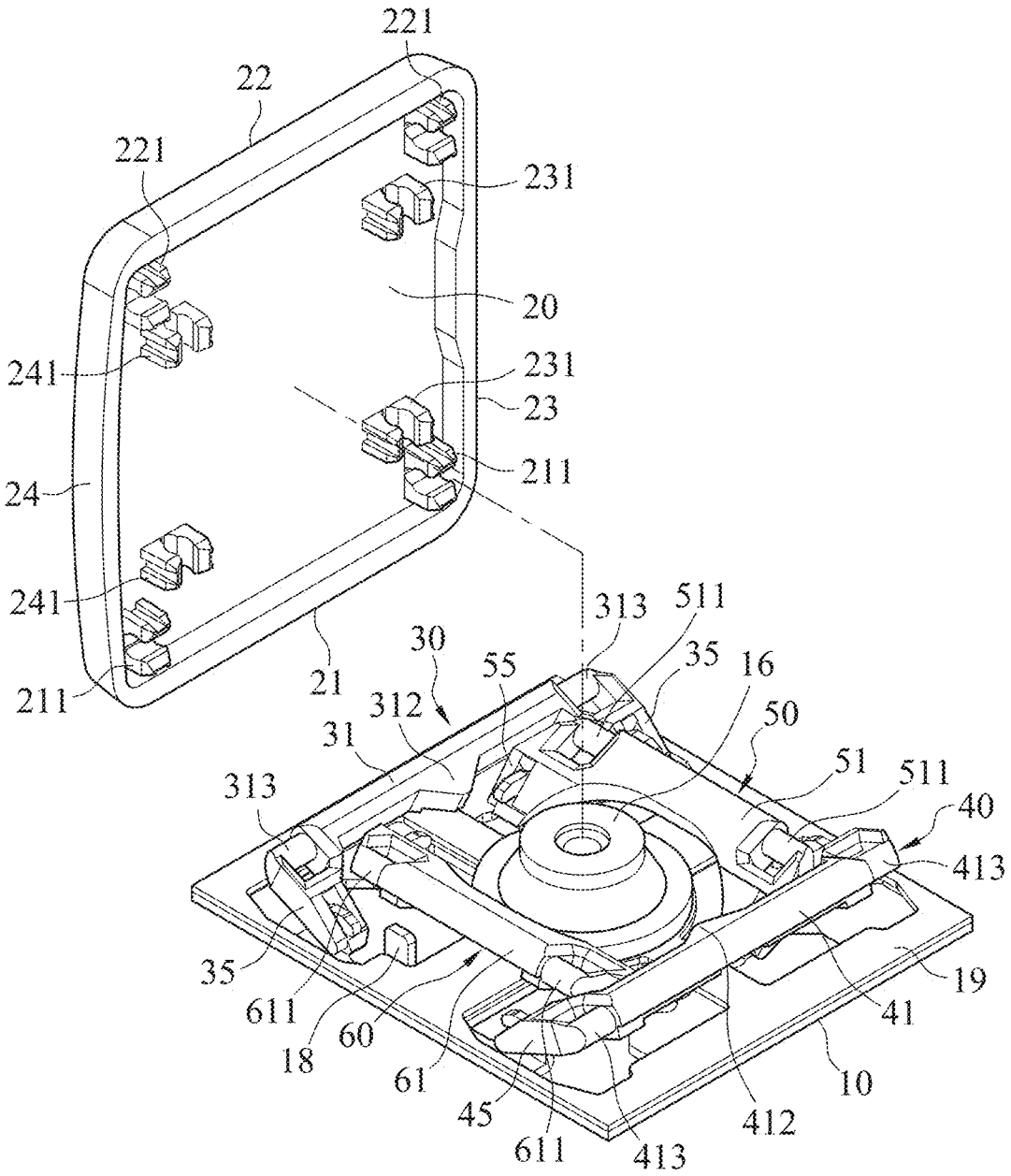
FIG. 2 illustrates a partial exploded view of the keyboard device of the exemplary embodiment.
Figure 3:
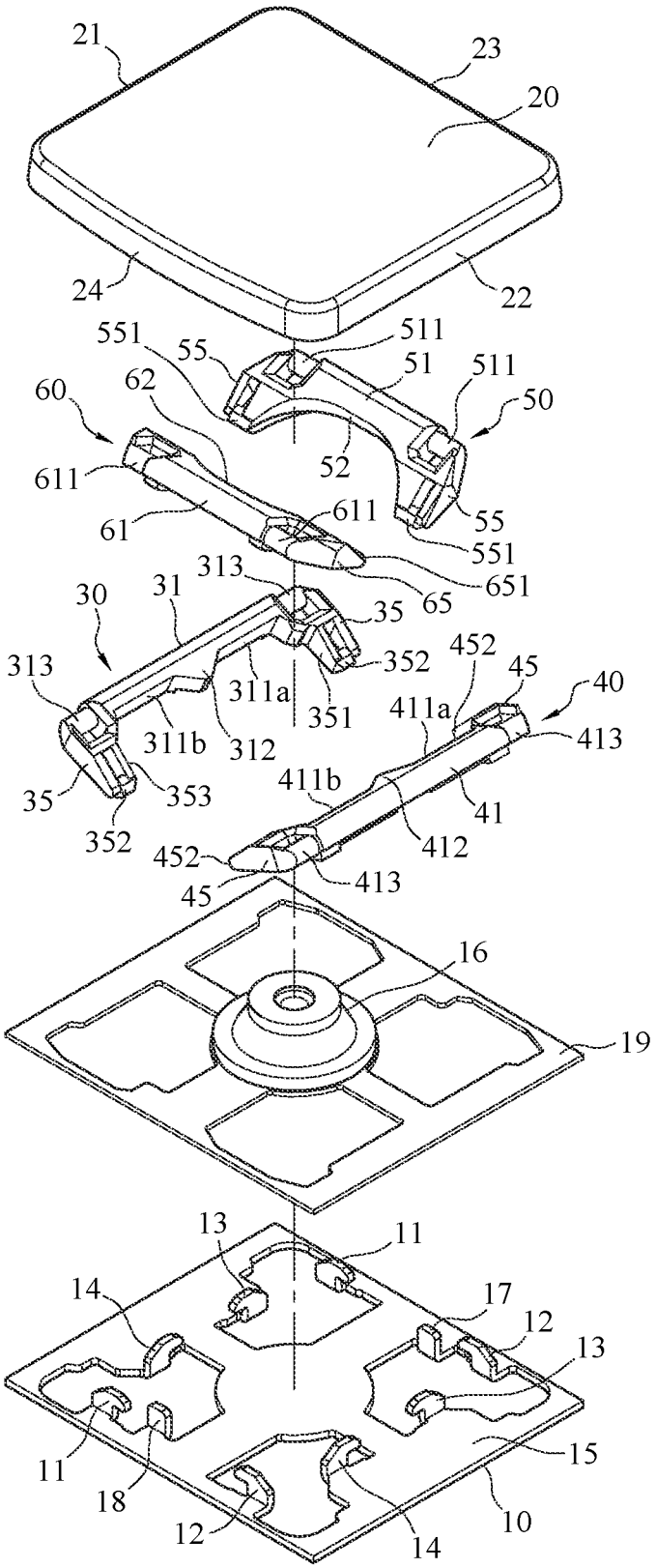
FIG. 3 illustrates another partial exploded view of the keyboard device of the exemplary embodiment.
Figure 4:
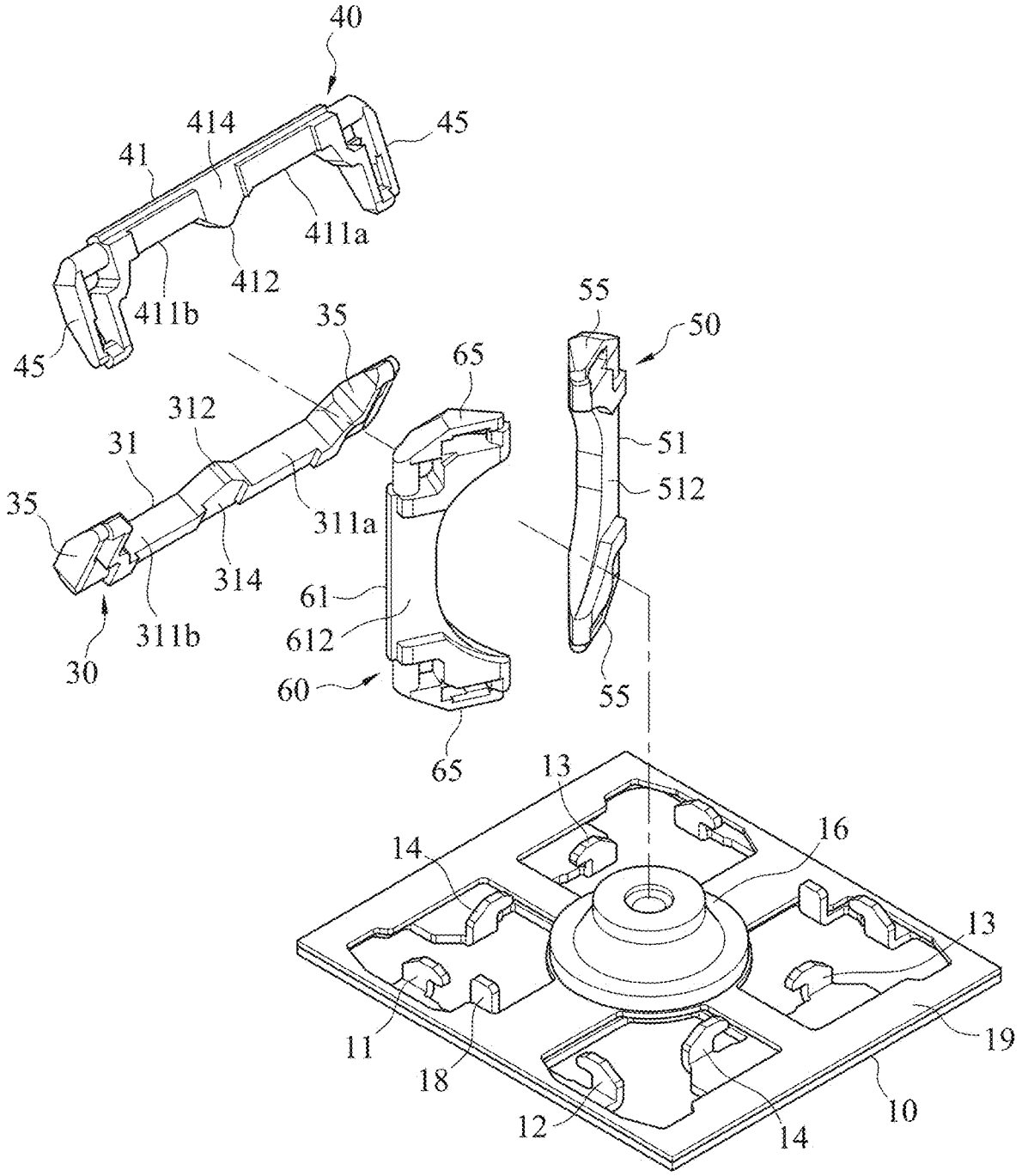
FIG. 4 illustrates yet another partial exploded view of the keyboard device of the exemplary embodiment.

FIG. 1 illustrates a perspective view of a keyboard device according to an exemplary embodiment of the instant disclosure. FIG. 2 illustrates a partial exploded view of the keyboard device of the exemplary embodiment. FIG. 3 illustrates another partial exploded view of the keyboard device of the exemplary embodiment. FIG. 4 illustrates yet another partial exploded view of the keyboard device of the exemplary embodiment. As shown in FIG. 1, the keyboard device 1 may be utilized in various electronic devices (e.g., laptop computers, notebook computers, or input devices of other electronic devices), and users can operate the keyboard device 1 to generate corresponding signal(s).

As shown in FIGS. 1 to 3, in this embodiment, the keyboard device 1 comprises a substrate 10, a plurality of keycaps, a first link member 30, and a second link member 40. The keycaps may comprise square keycaps 20 and large-sized keycaps 20*a*. The square keycap 20 has substantial the same length and width, and the square keycaps 20 may be, for example, keycaps of alphabet keys and number keys. As compared to the length-to-width ratio of the square keycap 20, the large-sized keycap 20*a* has a larger length-to-width ratio, and the large-sized keycaps 20*a* may be, for example, the keycaps of Space key, the Enter key, and the Caps Lock key. The first link member 30 and the second link member 40 are connected between one of the keycaps 20, 20*a* and the substrate 10. When the keycap 20, 20*a* is pressed, the keycap 20, 20*a* is moved downwardly through the guiding of the first link member 30 and the second link member 40. When the pressed keycap 20, 20*a* is released, the keycap 20, 20*a* is moved upwardly through the guiding of the first link member 30 and the second link member 40.

As shown in FIGS. 1 to 3, the substrate 10 may be a rigid plate made of metal (e.g., iron, aluminum, alloy), or plastic material. A resilient member 16 and a circuit board 19 may be disposed on the substrate 10. For example, the circuit board 19 may be a printed circuit board (PCB), a flexible print circuit board (FPCB), a rigid-flex PCB, etc. When the keycap 20 is pressed and moved downwardly, the keycap 20 presses the resilient member 16 to trigger the circuit board 19 to generate corresponding signal(s). When the keycap 20 is released, the keycap 20 is moved back to its original position (a position that the keycap 20 is not pressed) through the resilient member 16. In some embodiments, the resilient member 16 may be a metal dome, a rubber dome, a metal piece, a spring, a mechanical switch, etc.

As shown in FIGS. 1 to 3, in this illustrative embodiment, the first link member 30 and the second link member 40 are connected between the square keycap 20 and the substrate 10. The top surface of the substrate 10 has an assembling region 15 (as shown in FIG. 3) for being correspondingly assembled with the keycap 20, the first link member 30, and the second link member 40. The keycap 20 comprises a first side portion 21, a second side portion 22, a third side portion 23, and a fourth side portion 24. The first side portion 21, the second side portion 22, the third side portion 23, and the fourth side portion 24 are connected to one another. The first side portion 21 is opposite to the second side portion 22, and the third side portion 23 is opposite to the fourth side portion 24. Furthermore, the first side portion 21, the second side portion 22, the third side portion 23, and the fourth side portion 24 substantially have the same length, but embodiments are not limited thereto.

As shown in FIGS. 1 to 3, the first link member 30 is connected between the substrate 10 and the keycap 20, and the first link member 30 is adjacent to the first side portion 21 of the keycap 20. The first link member 30 comprises a first pivot arm 31 and two first short swing arms 35. The two first short swing arms 35 are respectively connected to two ends of the first pivot arm 31, and the first pivot arm 31 is pivotally connected to a bottom portion of the first side portion 21 of the keycap 20. Each of the first short swing arms 35 extends toward the second side portion 22 and is swingably connected to the substrate 10.

As shown in FIGS. 1 to 3, in this embodiment, two first shaft-holding portions 211 are disposed on the bottom portion of the keycap 20 and adjacent to the first side portion 21, and the two first shaft-holding portions 211 are spaced from each other. Two ends of the first pivot arm 31 of the first link member 30 have two first pivot shafts 313, and the two first shaft-holding portions 211 are correspondingly fitted over the two first pivot shafts 313. Therefore, the first pivot arm 31 of the first link member 30 can be pivotally connected to the bottom portion of the first side portion 21 of the keycap 20, so that the first link member 30 is rotatable with respect to the keycap 20. Moreover, the extension direction of the first pivot arm 31 is the same as the extension direction of the first side portion 21.

Furthermore, two first assembling members 11 protrude from the assembling region 15 of the substrate 10. The two first assembling members 11 are spaced from each other and are provided for being assembled with the two first short swing arms 35. For example, in this embodiment, each of the first assembling members 11 is a hook structure upwardly and integrally extending from the substrate 10 (in this embodiment, the hook structure is L-shaped, but may be U-shaped, T-shaped, or other-shaped). End portions 352 of the two first short swing arms 35 are engaged with the two first assembling members 11 respectively. Accordingly, when the keycap 20 is pressed and is moved downwardly toward the substrate 10, the end portion 352 of each of the first short swing arms 35 slides and rotates with respect to the corresponding first assembling member 11, so that each of the first short swing arms 35 swings with respect to the substrate 10.

As shown in FIGS. 1 to 3, the second link member 40 is connected between the substrate 10 and the keycap 20, and the second link member 40 is adjacent to the second side portion 22 of the keycap 20. The second link member 40 comprises a second pivot arm 41 and two second short swing arms 45. The two second short swing arms 45 are respectively connected to two ends of the second pivot arm 41, and the second pivot arm 41 is pivotally connected to a bottom portion of the second side portion 22 of the keycap 20. Each of the second short swing arms 45 extends toward the first side portion 21 and is swingably connected to the substrate 10.

As shown in FIGS. 1 to 3, in this embodiment, two second shaft-holding portions 221 are disposed on the bottom portion of the keycap 20 and adjacent to the second side portion 22, and the two second shaft-holding portions 221 are spaced from each other. Two ends of the second pivot arm 41 of the second link member 40 have two second pivot shafts 413, and the two second shaft-holding portions 221 are correspondingly fitted over the two second pivot shafts 413. Therefore, the second pivot arm 41 of the second link member 40 can be pivotally connected to the bottom portion of the second side portion 22 of the keycap 20, so that the second link member 40 is rotatable with respect to the keycap 20. Moreover, the extension direction of the second pivot arm 41 is the same as the extension direction of the second side portion 22.

Furthermore, two second assembling members 12 protrude from the assembling region 15 of the substrate 10. The two second assembling members 12 are spaced from each other and are provided for being assembled with the two second short swing arms 45. For example, in this embodiment, each of the second assembling members 12 is a hook structure upwardly and integrally extending from the substrate 10 (in this embodiment, the hook structure is L-shaped, but may be U-shaped, T-shaped, or other-shaped). End portions 452 of the two second short swing arms 45 are engaged with the two second assembling members 12 respectively. Accordingly, when the keycap 20 is pressed and is moved downwardly toward the substrate 10, the end portion 452 of each of the second short swing arms 45 slides and rotates with respect to the corresponding second assembling member 12, so that each of the second short swing arms 45 swings with respect to the substrate 10.

As shown in FIGS. 1 to 3, in this embodiment, the length of each of the first short swing arms 35 of the first link member 30 is less than half of the length of the first pivot arm 31 or is less than half of the length of the first side portion 21. For example, the length of each of the first short swing arms 35 is 1/10 to 3/10 of the length of the first pivot arm 31 or 1/10 to 3/10 of the length of the first side portion 21. Preferably, in some embodiments, for example, the length of each of the first short swing arms 35 is 2/10 of the length of the first pivot arm 31 or 2/10 of the length of the first side portion 21. In this embodiment, the length of each of the second short swing arms 45 of the second link member 40 is less than half of the length of the second pivot arm 41 or is less than half of the length of the second side portion 22. For example, the length of each of the second short swing arms 45 is 1/10 to 3/10 of the length of the second pivot arm 41 or 1/10 to 3/10 of the length of the second side portion 22. Preferably, in some embodiments, for example, the length of each of the second short swing arms 45 is 2/10 of the length of the second pivot arm 41 or 2/10 of the length of the second side portion 22. In this embodiment, the first side portion 21, the second side portion 22, the third side portion 23, and the fourth side portion 24 of the keycap 20 substantially have the same length. In this embodiment, the length of the first side portion 21 is 14 mm, and the length of each of the first short swing arms 35 may be in a range between 1.4 mm and 4.2 mm. Preferably, in some embodiments, the length of each of the first short swing arms 35 may be 2.8 mm. In this embodiment, the length of the second side portion 22 is 14 mm, and the length of each of the second short swing arms 45 may be in a range between 1.4 mm and 4.2 mm. Preferably, in some embodiments, the length of each of the second short swing arms 45 may be 2.8 mm.

Figure 6:
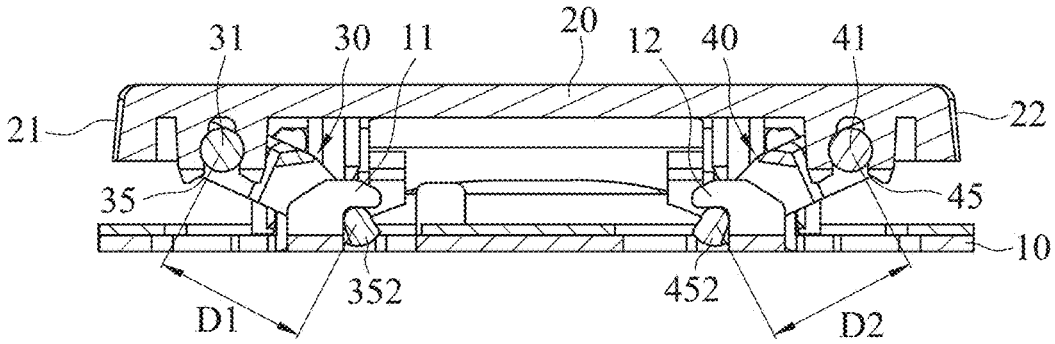
FIG. 6 illustrates a cross-sectional view along line 6-6 shown in FIG. 5.

In some embodiments, the length of the first short swing arm 35 is equal to the shaft distance D1 between the two rotation shafts at the two ends of the first short swing arm 35 (as shown in FIG. 6), and the length of the second short swing arm 45 is equal to the shaft distance D2 between the two rotation shafts at the two ends of the second short swing arm 45 (as shown in FIG. 6).

Accordingly, in the keyboard device 1 according to one or some embodiments of the instant disclosure, the first link member 30 and the second link member 40 are separated components and are respectively connected between the corresponding side portions of the keycap 20 and the substrate 10. Therefore, the assembling steps and the labor costs for the keyboard device 1 can be reduced. Specifically, as shown in FIGS. 2 and 3, in one or some embodiments, in the assembling process, the first link member 30 is engaged with the first assembling members 11 through the end portions 352 of the first short swing arms 35 and is placed on the substrate 10, and the second link member 40 is engaged with the second assembling members 12 through the end portions 452 of the second short swing arms 45 and is placed on the substrate 10. Then, forces are applied to allow the two first shaft-holding portions 211 and the two second shaft-holding portions 221 of the keycap 20 to be respectively fitted over the two first pivot shafts 313 and the two second pivot shafts 413. Thus, the assembling of the keycap 20 on the substrate 10 can be achieved quickly. As compared with a keyboard device with a scissor-type connection member known to the inventor(s), according to one or some embodiments of the instant disclosure, the first link member 30 and the second link member 40 do not need to be preassembled, thereby reducing the assembling steps and the labor costs for the keyboard device 1.

Furthermore, according to one or some embodiments, the length of each of the first short swing arms 35 is less than half of the length of the first pivot arm 31 or less than half of the length of the first side portion 21, and the length of each of the second short swing arms 45 is less than half of the length of the second pivot arm 41 or less than half of the length of the second side portion 22. Therefore, as compared with a keyboard device having a scissor-type connection member known to the inventor(s), according one or some embodiments of the instant disclosure, the material for making the link members 30, 40 and the overall size of the link members 30, 40 can be greatly reduced, thereby reducing the manufacturing tolerances of the link members 30, 40 and allowing the precision of the assembled keyboard device 1 to be predicted easily. Hence, the keycaps 20 are at a uniform height when the keycaps 20 are not pressed, thereby facilitating in controlling the height of the keyboard device 1. Moreover, since the first short swing arms 35 and the second short swing arms 45 have reduced lengths, the risk that the first short swing arms 35 (or the second short swing arms 45) are warped or broken upon the first short swing arms 35 (or the second short swing arms 45) suffering a force can be greatly reduced.

Figure 7:
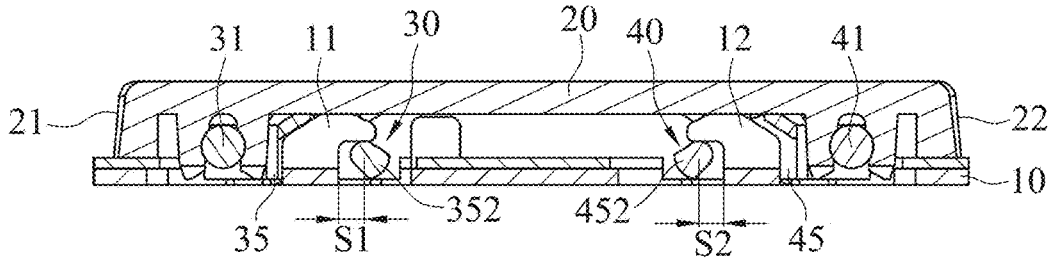
FIG. 7 illustrates a schematic view showing that the keyboard device shown in FIG. 6 is pressed.

Moreover, as shown in FIG. 6, the shaft distance D1 of each of the first short swing arms 35 and the shaft distance D2 of each of the second short swing arms 45 are greatly reduced, as compared with the shaft distance of the scissor-type connection member known to the inventor(s). Therefore, when the first link member 30 and the second link member 40 are applied to a key having a low keystroke (e.g., the up-down stroke of the key is about between 0.5 mm and 1.5 mm), the keycaps 20 of the low-keystroke keys can be prevented from having uneven heights which may be caused by the tolerance of the substrate 10. Specifically, since the scissor-type connection member has a long shaft distance, when the scissor-type connection member is applied to a key having a low keystroke, the swinging angle of the scissor-type connection member is reduced, such that the horizontal sliding movement of the scissor-type connection member is reduced as well. As a result, for the keyboard device having the scissor-type connection member, the tolerance of the substrate greatly affects the flatness of the plurality of keycaps of the low-keystroke keys. On the other hand, as shown in FIG. 7, according to one or some embodiments of the instant disclosure, the shaft distance D1 of each of the first short swing arms 35 and the shaft distance D2 of each of the second short swing arms 45 are greatly reduced, as compared with the shaft distance of the scissor-type connection member. Therefore, in the case that the first link member 30 and the second link member 40 are applied to a key having a low keystroke, when the keycap 20 is pressed and is moved downwardly toward the substrate 10, the swinging angle of each of the first short swing arms 35 and the swinging angle of each of the second short swing arms 45 are greater than the swinging angle of the scissor-type connection member. Hence, the movement of the end portion 352 of each of the first short swing arms 35 with respect to the corresponding first assembling member 11 (as the sliding movement S1 shown in FIG. 7) is greater than the horizontal sliding movement of the scissor-type connection member, and the movement of the end portion 452 of each of the second short swing arms 45 with respect to the corresponding second assembling member 12 (as the sliding movement shown in FIG. 7) is greater than the horizontal sliding movement of the scissor-type connection member. Consequently, the flatness of the plurality of keycaps 20 can be prevented from being affected by the tolerance of the substrate 10.

Furthermore, through configuring the first short swing arms 35 and the second short swing arms 45 with short shaft distances, the pressing force on the keycap 20 can be transmitted in a quicker and more direct manner. Therefore, even when the corner portion of the keycap 20 is pressed, the keycap 20 still can be moved downwardly toward the substrate 10 in a stable manner, being more satisfied with the requirements for a key having a low keystroke (e.g., the up-down stroke of the key is about between 0.5 mm and 1.5 mm).

Figure 5:
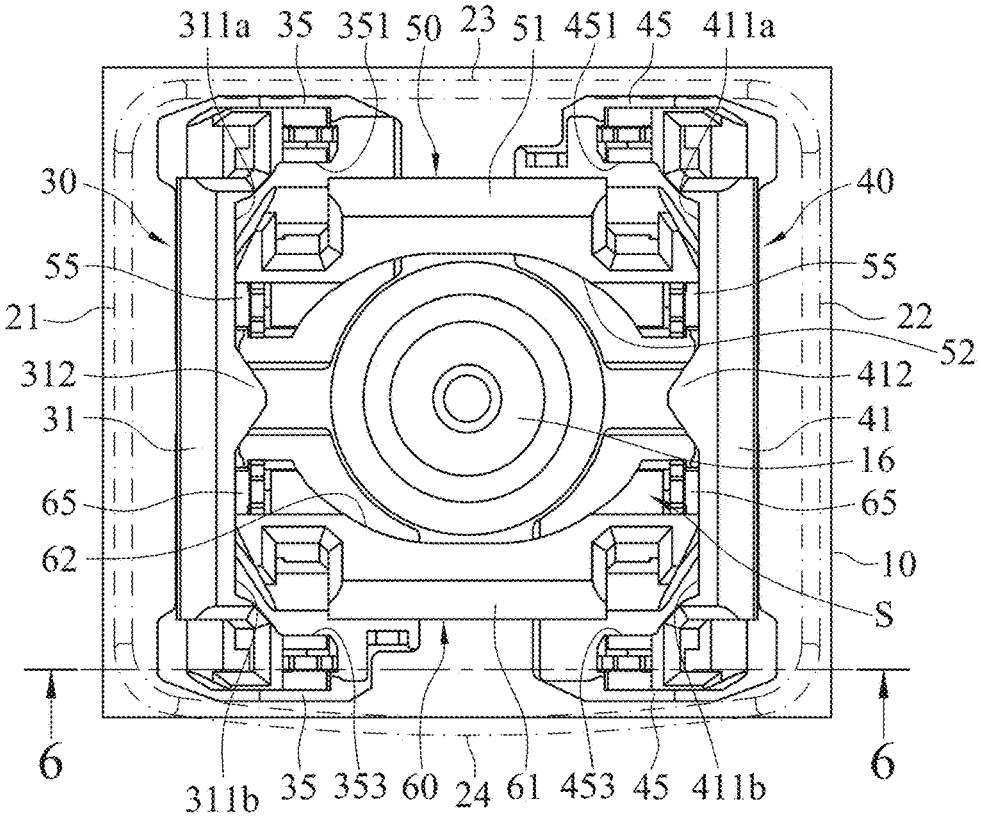
FIG. 5 illustrates a partial top view of the keyboard device of the exemplary embodiment.

In some embodiments, the first link member 30 and the second link member 40 may have the same structure, thus facilitating in the manufacturing and the assembling of the keyboard device 1. As shown in FIG. 5, in this embodiment, the first link member 30 and the second link member 40 are arranged symmetrically by taking the center of the keycap 20 as the symmetry center.

Further, as shown in FIGS. 1 to 3, in this embodiment, a third link member 50 and a fourth link member 60 are connected between the substrate 10 and the keycap 20. The third link member 50 is adjacent to the third side portion 23 of the keycap 20, and the fourth link member 60 is adjacent to the fourth side portion 24 of the keycap 20. Accordingly, four side portions of the keycap 20 are respectively assembled with link members. Therefore, when any portion of the keycap 20 is pressed, the entire keycap 20 can be moved downwardly in an even manner to prevent from that the loosening of the keycap 20, the wobbling of the keycap 20, or the tilting of the keycap 20. Hence, according to one or some embodiments, when the keycap 20 is pressed, corresponding signal(s) can be ensured to be generated, and the user can have an improved operation feeling for pressing the keycap 20.

As shown in FIGS. 1 to 3, in this embodiment, the third link member 50 comprises a third pivot arm 51 and two third short swing arms 55. The two third short swing arms 55 are respectively connected to two ends of the third pivot arm 51, and the third pivot arm 51 is pivotally connected to a bottom portion of the third side portion 23 of the keycap 20. The extension direction of the third pivot arm 51 is perpendicular to the extension direction of the first pivot arm 31 and the extension direction of the second pivot arm 41. Each of the third short swing arms 55 extends toward the fourth side portion 24 and is swingably connected to the substrate 10. The fourth link member 60 comprises a fourth pivot arm 61 and two fourth short swing arms 65. The two fourth short swing arms 65 are respectively connected to two ends of the fourth pivot arm 61. The extension direction of the fourth pivot arm 61 is perpendicular to the extension direction of the first pivot arm 31 and the extension direction of the second pivot arm 41. Each of the fourth short swing arms 65 extends toward the third side portion 23 and is swingably connected to the substrate 10.

Furthermore, as shown in FIGS. 2 and 3, in this embodiment, two third shaft-holding portions 231 are disposed on the bottom portion of the keycap 20 and adjacent to the third side portion 23, and the two third shaft-holding portions 231 are spaced from each other. Two ends of the third pivot arm 51 of the third link member 50 have two third pivot shafts 511, and the two third shaft-holding portions 231 are correspondingly fitted over the two third pivot shafts 511. Therefore, the third pivot arm 51 of the third link member 50 can be pivotally connected to the bottom portion of the third side portion 23 of the keycap 20, so that the third link member 50 is rotatable with respect to the keycap 20. Moreover, the extension direction of the third pivot arm 51 is the same as the extension direction of the third side portion 23.

Furthermore, two third assembling members 13 protrude from the assembling region 15 of the substrate 10. The two third assembling members 13 are spaced from each other and are provided for being assembled with the two third short swing arms 55. For example, in this embodiment, each of the third assembling members 13 is a hook structure upwardly and integrally extending from the substrate 10 (in this embodiment, the hook structure is L-shaped, but may be U-shaped, T-shaped, or other-shaped). End portions 551 of the two third short swing arms 55 are engaged with the two third assembling members 13. Accordingly, when the keycap 20 is pressed and is moved downwardly toward the substrate 10, the end portion 551 of each of the third short swing arms 55 slides and rotates with respect to the corresponding third assembling member 13, so that each of the third short swing arms 55 swings with respect to the substrate 10.

Moreover, as shown in FIGS. 2 and 3, in this embodiment, two fourth shaft-holding portions 241 are disposed on the bottom portion of the keycap 20 and adjacent to the fourth side portion 24, and the two fourth shaft-holding portions 241 are spaced from each other. Two ends of the fourth pivot arm 61 of the fourth link member 60 have two fourth pivot shafts 611, and the two fourth shaft-holding portions 241 are correspondingly fitted over the two fourth pivot shafts 611. Therefore, the fourth pivot arm 61 of the fourth link member 60 can be pivotally connected to the bottom portion of the fourth side portion 24 of the keycap 20, so that the fourth link member 60 is rotatable with respect to the keycap 20. Moreover, the extension direction of the fourth pivot arm 61 is the same as the extension direction of the fourth side portion 24.

Furthermore, two fourth assembling members 14 protrude from the assembling region 15 of the substrate 10. The two fourth assembling members 14 are spaced from each other and are provided for being assembled with the two fourth short swing arms 65. For example, in this embodiment, each of the fourth assembling members 14 is a hook structure upwardly and integrally extending from the substrate 10 (in this embodiment, the hook structure is L-shaped, but may be U-shaped, T-shaped, or other-shaped). End portions 651 of the two fourth short swing arms 65 are engaged with the two fourth assembling members 14. Accordingly, when the keycap 20 is pressed and is moved downwardly toward the substrate 10, the end portion 651 of each of the fourth short swing arms 65 slides and rotates with respect to the corresponding fourth assembling member 14, so that each of the fourth short swing arms 65 swings with respect to the substrate 10.

As shown in FIGS. 1 to 3, in this embodiment, the length of each of the third short swing arms 55 of the third link member 50 is less than half of the length of the third pivot arm 51 or is less than half of the length of the third side portion 23. For example, the length of each of the third short swing arms 55 is 1/10 to 3/10 of the length of the third pivot arm 51 or 1/10 to 3/10 of the length of the third side portion 23. Preferably, in some embodiments, for example, the length of each of the third short swing arms 55 is 2/10 of the length of the third pivot arm 51 or 2/10 of the length of the third side portion 23. In this embodiment, the length of each of the fourth short swing arms 65 of the fourth link member 60 is less than half of the length of the fourth pivot arm 61 or is less than half of the length of the fourth side portion 24. For example, the length of each of the fourth short swing arms 65 is 1/10 to 3/10 of the length of the fourth pivot arm 61 or 1/10 to 3/10 of the length of the fourth side portion 24. Preferably, in some embodiments, for example, the length of each of the fourth short swing arms 65 is 2/10 of the length of the fourth pivot arm 61 or 2/10 of the length of the fourth side portion 24. For example, the length of the third pivot arm 51 or the length of the third side portion 23 is 14 mm, and the length of each of the third short swing arms 55 may be in a range between 1.4 mm and 4.2 mm. Preferably, in some embodiments, the length of each of the third short swing arms 55 may be 2.8 mm. For example, the length of the fourth pivot arm 61 or the length of the fourth side portion 24 is 14 mm, and the length of each of the fourth short swing arms 65 may be in a range between 1.4 mm and 4.2 mm. Preferably, in some embodiments, the length of each of the fourth short swing arms 65 may be 2.8 mm.

As shown in FIGS. 2 and 3, in this embodiment, the length of the first pivot arm 31 is near to the length of the first side portion 21, the length of the second pivot arm 41 is near to the length of the second side portion 22, the length of the third pivot arm 51 is near to the length of the third side portion 23, and the length of the fourth pivot arm 61 is near to the length of the fourth side portion 24. The two first shaft-holding portions 211, the two second shaft-holding portions 221, the two third shaft-holding portions 231, and the two fourth shaft-holding portions 241 of the keycap 20 are respectively adjacent to four corners of the bottom portion of the keycap 20. Therefore, the two ends of the first pivot arm 31, the two ends of the second pivot arm 41, the two ends of the third pivot arm 51, and the two ends of the fourth pivot arm 61 are respectively adjacent to the four corners of the keycap 20. Hence, during the operation of the keyboard device 1, even when the user presses the corner of the keycap 20 of the keyboard device 1, the entire keycap 20 can be moved downwardly in an even manner.

As shown in FIG. 5, in this embodiment, a side of the third pivot arm 51 of the third link member 50 facing the fourth link member 60 comprises an inner receding portion 52 (in this embodiment, the inner receding portion 52 is curved), and a side of the fourth pivot arm 61 of the fourth link member 60 facing the third link member 50 comprises an inner receding portion 62 (in this embodiment, the inner receding portion 62 is curved). The resilient member 16 is received in the inner receding portion 52 and the inner receding portion 62. Therefore, the resilient member 16 can be disposed on the substrate 10 and corresponds to a bottom portion of the keycap 20.

Further, as shown in FIGS. 3 and 5, in this embodiment, the two first short swing arms 35 of the first link member 30 are respectively adjacent to the third side portion 23 and the fourth side portion 24 of the keycap 20, and the two second short swing arms 45 of the second link member 40 are respectively adjacent to the third side portion 23 and the fourth side portion 24 of the keycap 20. Moreover, the first pivot arm 31 and the two first short swing arms 35 of the first link member 30 and the second pivot arm 41 and the two second short swing arms 45 of the second link member 40 enclose a receiving space S. The third link member 50 and the fourth link member 60 may have the same structure, thus facilitating in the manufacturing and the assembling of the keyboard device 1. Moreover, the third link member 50 and the fourth link member 60 are in the receiving space S, and the third link member 50 and the fourth link member 60 are arranged symmetrically by taking the center of the keycap 20 as the symmetry center.

As shown in FIGS. 3 and 5, in this embodiment, the first short swing arm 35 of the first link member 30 adjacent to the third side portion 23 comprises a first indentation 351, and the first indentation 351 is recessed at a side portion of the first short swing arm 35 facing the third link member 50. In this embodiment, the second short swing arm 45 of the second link member 40 adjacent to the third side portion 23 comprises a second indentation 451, and the second indentation 451 is recessed at a side portion of the second short swing arm 45 facing the third link member 50. Moreover, at least a portion of the third link member 50 corresponds to the first indentation 351 and the second indentation 451. Furthermore, in this embodiment, the first short swing arm 35 of the first link member 30 adjacent to the fourth side portion 24 comprises a third indentation 353, and the third indentation 353 is recessed at a side portion of the first short swing arm 35 facing the fourth link member 60. Similarly, in this embodiment, the second short swing arm 45 of the second link member 40 adjacent to the fourth side portion 24 comprises a fourth indentation 453, and the fourth indentation 453 is recessed at a side portion of the second short swing arm 45 facing the fourth link member 60. Moreover, at least a portion of the fourth link member 60 corresponds to the third indentation 353 and the fourth indentation 453.

Furthermore, as shown in FIGS. 3 and 5, in this embodiment, the two ends of the third pivot arm 51 of the third link member 50 are respectively above the first indentation 351 and the second indentation 451. Moreover, in this embodiment, the two third pivot shafts 511 are at the two ends of the third pivot arm 51 and are respectively above the first indentation 351 and the second indentation 451, but embodiments are not limited thereto. In this embodiment, the two ends of the fourth pivot arm 61 of the fourth link member 60 are respectively above the third indentation 353 and the fourth indentation 453. Moreover, in this embodiment, the two fourth pivot shafts 611 are at the two ends of the fourth pivot arm 61 and are respectively above the third indentation 353 and the fourth indentation 453, but embodiments are not limited thereto. When the keycap 20 is pressed and is moved downwardly toward the substrate 10, the two ends of the third pivot arm 51 of the third link member 50 are respectively received in the first indentation 351 and the second indentation 451, and the two ends of the fourth pivot arm 61 of the fourth link member 60 are respectively received in the third indentation 353 and the fourth indentation 453. Accordingly, the position of the third pivot arm 51 of the third link member 50 may be designed nearer to the third side portion 23 of the keycap 20, and the position of the fourth pivot arm 61 of the fourth link member 60 may be designed nearer to the fourth side portion 24 of the keycap 20. Hence, when the third side portion 23 or the fourth side portion 24 of the keycap 20 is pressed, the pressing force can be transmitted to other portions of the keycap 20 through the third link member 50 and the fourth link member 60.

As shown in FIGS. 3 and 5, a side portion of the first pivot arm 31 of the first link member 30 facing the second link member 40 comprises two first receding portions 311*a*, 311*b*, and a side portion of the second pivot arm 41 of the second link member 40 facing the first link member 30 comprises two second receding portions 411*a*, 411*b*. The first receding portion 311*a* and the second receding portion 411*a* are adjacent to the third side portion 23 of the keycap 20, and the two third short swing arms 55 of the third link member 50 are respectively received in the first receding portion 311*a* and the second receding portion 411*a*. Therefore, the positions of the two third short swing arms 55 of the third link member 50 may be designed nearer to the first side portion 21 and the second side portion 22 of the keycap 20, respectively. Similarly, the first receding portion 311*b* and the second receding portion 411*b* are adjacent to the fourth side portion 24 of the keycap 20, and the two fourth short swing arms 65 of the fourth link member 60 are respectively received in the first receding portion 311*b* and the second receding portion 411*b*. Therefore, the positions of the two fourth short swing arms 65 of the fourth link member 60 may be designed nearer to the first side portion 21 and the second side portion 22 of the keycap 20, respectively. Accordingly, when the first side portion 21 or the second side portion 22 of the keycap 20 is pressed, the pressing force can be transmitted to other portions of the keycap 20 properly.

In addition to the foregoing advantages, according to one or some embodiments of the instant disclosure, the first link member 30 comprises the first indentation 351, the third indentation 353, and the two first receding portions 311*a*, 311*b*, and the second link member 40 comprises the second indentation 451, the fourth indentation 453, and the two second receding portions 411*a*, 411*b*. Therefore, the material for manufacturing the first link member 30 and the second link member 40 may be further reduced, thereby having advantages such as reducing the manufacturing costs, the manufacturing tolerance, and the weight of the keyboard device 1. Moreover, each of the first short swing arms 35 and the two ends of the first pivot arm 31 of the first link member 30, each of the second short swing arms 45 and the two ends of the second pivot arm 41 of the second link member 40, each of the third short swing arms 55 and the two ends of the third pivot arm 51 of the third link member 50, and each of the fourth short swing arms 65 and the two ends of the fourth pivot arm 61 of the fourth link member 60 can be designed near to the corners of the keycap 20 by the greatest extent. Hence, when the corner of the keycap 20 is pressed, the pressing force can be transmitted to other portions of the keycap 20, so that the entire keycap 20 can be moved downwardly in an even manner.

As shown in FIGS. 3 and 5, a first reinforcing block 312 protrudes from the side portion of the first pivot arm 31 of the first link member 30 facing the second link member 40. In this embodiment, the first reinforcing block 312 is an extension portion integrally extending from the first pivot arm 31. In this embodiment, the first reinforcing block 312 is at a middle portion of the first pivot arm 31 for reinforcing the structural strength of the middle portion of the first pivot arm 31. The first receding portion 311*a* is formed between the first reinforcing block 312 and the first short swing arm 35 adjacent to the third side portion 23, and the first receding portion 311*b* is formed between the first reinforcing block 312 and the first short swing arm 35 adjacent to the fourth side portion 24.

As shown in FIGS. 3 and 5, a second reinforcing block 412 protrudes from the side portion of the second pivot arm 41 of the second link member 40 facing the first link member 30. In this embodiment, the second reinforcing block 412 is an extension portion integrally extending from the second pivot arm 41. In this embodiment, the second reinforcing block 412 is at a middle portion of the second pivot arm 41 for reinforcing the structural strength of the middle portion of the second pivot arm 41. The second receding portion 411*a* is formed between the second reinforcing block 412 and the second short swing arm 45 adjacent to the third side portion 23, and the second receding portion 411*b* is formed between the second reinforcing block 412 and the second short swing arm 45 adjacent to the fourth side portion 24.

It is understood that, according to one or some embodiments of the instant disclosure, since the first pivot arm 31 of the first link member 30 comprises the first receding portions 311*a*, 311*b*, the structural strength of the first pivot arm 31 can be reinforced by the first reinforcing block 312. Hence, the first pivot arm 31 can be prevented from being broken or warped upon the first pivot arm 31 suffering a force. Similarly, since the second pivot arm 41 of the second link member 40 comprises the second receding portions 411*a*, 411*b*, the structural strength of the second pivot arm 41 can be reinforced by the second reinforcing block 412. Hence, the second pivot arm 41 can be prevented from being broken or warped upon the second pivot arm 41 suffering a force.

In some embodiments, the width of the first reinforcing block 312 decreases from the first pivot arm 31 toward the second pivot arm 41, and the width of the second reinforcing block 412 decreases from the second pivot arm 41 toward the first pivot arm 31. Therefore, the accommodation spaces of the first receding portions 311*a*, 311*b* and the second receding portions 411*a*, 411*b* can be further increased, thereby facilitating in assembling the two third short swing arms 55 and the two fourth short swing arms 65 with the first receding portions 311*a*, 311*b* and the second receding portions 411*a*, 411*b*. As shown in FIGS. 3 and 5, in this embodiment, the first reinforcing block 312 and the second reinforcing block 412 are triangular blocks and have gradually-reduced widths, but embodiments are not limited thereto. In some embodiments, the first reinforcing block 312 and the second reinforcing block 412 may be trapezoid-shaped blocks, cone-shaped blocks, semicircle-shaped blocks, or blocks with other irregular shapes.

As shown in FIGS. 3 and 4, in this embodiment, the bottom portion of the first pivot arm 31 of the first link member 30 (namely, the surface of the first pivot arm 31 facing the circuit board 19) further comprises an receding groove 314 corresponding to a portion of the circuit board 19. In this embodiment, the receding groove 314 is at a middle portion of the bottom portion of the first pivot arm 31, such that the middle portion of the first pivot arm 31 has a reduced thickness. Therefore, when the keycap 20 is pressed and moved downwardly, a portion of the circuit board 19 can be received in the receding groove 314 to prevent from interfering with the first link member 30. Moreover, the first reinforcing block 312 may correspond to the receding groove 314 for achieving the structural reinforcement effect. Furthermore, in this embodiment, the bottom portion of the second pivot arm 41 of the second link member 40 (namely, the surface of the second pivot arm 41 facing the circuit board 19) further comprises an receding groove 414 corresponding to a portion of the circuit board 19. In this embodiment, the receding groove 414 is at a middle portion of the bottom portion of the second pivot arm 41, such that the middle portion of the second pivot arm 41 has a reduced thickness. Therefore, when the keycap 20 is pressed and moved downwardly, a portion of the circuit board 19 can be received in the receding groove 414 to prevent from interfering with the second link member 40. Moreover, the second reinforcing block 412 may correspond to the receding groove 414 for achieving the structural reinforcement effect.

Further, as shown in FIGS. 3 and 4, in this embodiment, the bottom portion of the third pivot arm 51 of the third link member 50 (namely, the surface of the third pivot arm 51 facing the circuit board 19) further comprises an receding groove 512 corresponding to a portion of the circuit board 19, and the bottom portion of the fourth pivot arm 61 of the fourth link member 60 (namely, the surface of the fourth pivot arm 61 facing the circuit board 19) further comprises an receding groove 612 corresponding to a portion of the circuit board 19. Accordingly, when the keycap 20 is pressed and moved downwardly, portions of the circuit board 19 can be received in the receding grooves 512, 612 to prevent from interfering with the third link member 50 and the fourth link member 60.

As shown in FIGS. 2 and 3, a first stopping member 17 and a second stopping member 18 are further on the substrate 10. In this embodiment, the first stopping member 17 and the second stopping member 18 are plates upwardly and integrally extending from the substrate 10. The first stopping member 17 is nearer to the third side portion 23 of the keycap 20, as compared with the two third assembling members 13; in other words, in this embodiment, the distance between the first stopping member 17 and the third side portion 23 of the keycap 20 is less than the distance between the two third assembling members 13 and the third side portion 23 of the keycap 20. The third pivot arm 51 of the third link member 50 is adjacent to the first stopping member 17. The second stopping member 18 is nearer to the fourth side portion 24 of the keycap 20, as compared with the two fourth assembling members 14; in other words, in this embodiment, the distance between the second stopping member 18 and the fourth side portion 24 of the keycap 20 is less than the distance between the two fourth assembling members 14 and the fourth side portion 24 of the keycap 20. The fourth pivot arm 61 of the fourth link member 60 is adjacent to the second stopping member 18. Accordingly, during the assembling process of the keyboard device 1, when the end portions 551 of the two third short swing arms 55 of the third link member 50 are respectively engaged with the two third assembling members 13 so as to be placed on the substrate 10, the first stopping member 17 can provide the third link member 50 with a limiting function to prevent the deflection of the third link member 50. Similarly, when the end portions 651 of the two fourth short swing arms 65 of the fourth link member 60 are respectively engaged with the two fourth assembling members 14 so as to be placed on the substrate 10, the second stopping member 18 can provide the fourth link member 60 with a limiting function to prevent the deflection of the fourth link member 60. Accordingly, when the keycap 20 is assembled with the third link member 50 and the fourth link member 60, the two third shaft-holding portions 231 and the two fourth shaft-holding portions 241 can be respectively fitted over the two third pivot shafts 511 of the third pivot arm 51 and the two fourth pivot shafts 611 of the fourth pivot arm 61 in a proper manner.

Figure 8:
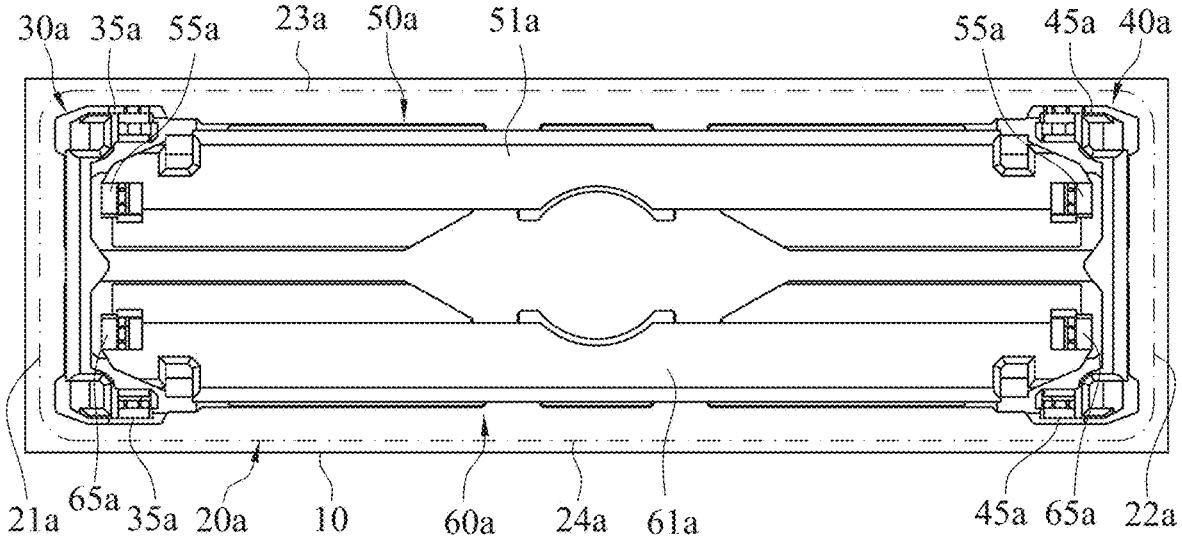
FIG. 8 illustrates a partial top view of a keyboard device according to another exemplary embodiment of the instant disclosure.
Figure 9:
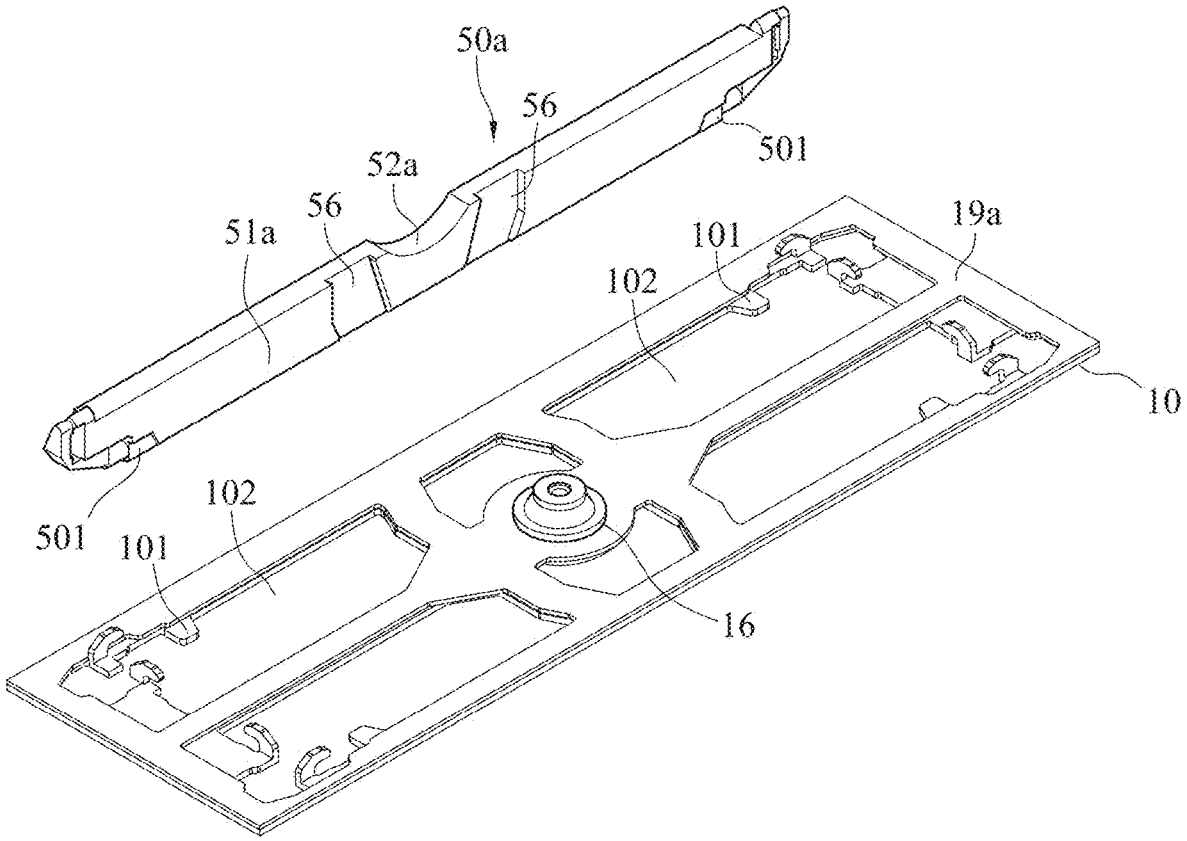
FIG. 9 illustrates a partial exploded view of the keyboard device of the another exemplary embodiment.

FIG. 8 illustrates a partial top view of a keyboard device according to another exemplary embodiment of the instant disclosure, and FIG. 9 illustrates a partial exploded view of the keyboard device of the another exemplary embodiment. As shown in FIGS. 1 and 8, in this embodiment, the keycap is the large-sized keycap 20*a* which has a larger length-to-width ratio. In this embodiment, the first link member 30*a*, the second link member 40*a*, the third link member 50*a*, and the fourth link member 60*a* are also connected between the keycap 20*a* and the substrate 10. The difference between the embodiment shown in FIGS. 8 and 9 and the embodiment shown in FIG. 5 is at least that, in this embodiment, the length of the first side portion 21*a* or the length of the second side portion 22*a* is less than the length of the third side portion 23*a* or the length of the fourth side portion 24*a*. Therefore, in embodiment, the third pivot arm 51*a* of the third link member 50*a* and the fourth pivot arm 61*a* of the fourth link member 60*a* have longer lengths to correspond to the length of the third side portion 23*a* and the length of the fourth side portion 24*a*.

Further, as shown in FIG. 8, in this embodiment, the length of each of the first short swing arms 35*a* of the first link member 30*a*, the length of each of the second short swing arms 45*a* of the second link member 40*a*, the length of each of the third short swing arms 55*a* of the third link member 50*a*, and the length of each of the fourth short swing arms 65*a* of the fourth link member 60*a* are all less than half of the length of the short side of the keycap 20*a* (namely, in this embodiment, the first side portion 21*a* or the second side portion 22*a*). For example, the length of each of the short swing arms of the link members may be 1/10 to 3/10 of the length of the short side. Preferably, in one embodiment, the length of each of the short swing arms of the link members may be 2/10 of the length of the short side. For example, supposed that the length of the first side portion 21*a* is 14 mm, the length of each of the first short swing arms 35*a*, the length of each of the second short swing arms 45*a*, the length of each of the third short swing arms 55*a*, and the length of each of the fourth short swing arms 65*a* may be in a range between 1.4 mm and 4.2 mm. Preferably, the length of each of the short swing arms of the link members may be 2.8 mm.

As shown in FIG. 9, in order to allow the third link member 50*a* and the fourth link member 60*a* with longer lengths to be assembled with the substrate 10 in an easier manner, alignment portions corresponding to the third link member 50*a* and the fourth link member 60*a* may be provided on the substrate 10. Taking the third link member 50*a* as an example, the substrate 10 may have at least one first alignment portion 101. The first alignment portion 101 is a plate integrally extending from the substrate 10. In this embodiment, the number of the first alignment portions 101 is two and the two first alignment portions 101 are respectively adjacent to the two ends of third link member 50*a*. In this embodiment, the substrate 10 has several hollowed portions 102, and the two first alignment portions 101 are plates and respectively disposed in the two hollowed portions 102. A side portion of the third link member 50*a* adjacent to the substrate 10 has second alignment portions 501, and the number of the second alignment portions 501 corresponds to the number of the first alignment portions 101. In this embodiment, the second alignment portions 501 are recesses. Accordingly, during assembling the third link member 50*a* on the substrate 10, the second alignment portions 501 of the third link member 50*a* may be respectively arranged with the first alignment portions 101 of the substrate 10, so that the third link member 50*a* can be placed at a correct assembling position of the substrate 10 for assembling with the keycap 20*a*. Moreover, during assembling the keycap 20*a* with the third link member 50*a*, each of the first alignment portions 101 can support the third link member 50*a* to prevent the third link member 50*a* from being bent, deflected, or deformed upon suffering a force.

However, it is understood that the foregoing embodiment is provided as an illustrative example, the first alignment portion 101 and the second alignment portion 501 can be any structures capable of mating with each other. For example, the first alignment portion 101 may be a recess, and the second alignment portion 501 may be a plate.

Further, as shown in FIG. 9, in this embodiment, a middle portion of the inner side of the third link member 50*a* comprises an inner receding portion 52*a* (in this embodiment, the inner receding portion 52*a* is curved) for receiving the resilient member 16. A circuit board 19*a* is disposed on the substrate 10. Moreover, the bottom portion of the third link member 50*a* further comprises two receding grooves 56 to receive portions of the circuit board 19*a*. Moreover, in this embodiment, the two receding grooves 56 are respectively at two opposite sides of the inner receding portion 52*a*. Therefore, the thickness of the portion of the third link member 50*a* having to the inner receding portion 52*a* can be retained, such that the structural strength of the portion of the third link member 50*a* having the inner receding portion 52*a* can be prevented from being decreased.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A keyboard device comprising:

a substrate;

a keycap disposed on the substrate, wherein the keycap comprises a first side portion, a second side portion, a third side portion, and a fourth side portion, wherein the first side portion, the second side portion, the third side portion, and the fourth side portion are connected to one another, and wherein the first side portion is opposite to the second side portion, and the third side portion is opposite to the fourth side portion;

a first link member connected between the substrate and the keycap, wherein the first link member comprises a first pivot arm and two first short swing arms, wherein the two first short swing arms are respectively connected to two ends of the first pivot arm, and a length of each of the first short swing arms is less than half of a length of the first pivot arm, and wherein the first pivot arm is pivotally connected to a bottom portion of the first side portion of the keycap, and each of the first short swing arms is swingably connected to the substrate;

a second link member connected between the substrate and the keycap, wherein the second link member comprises a second pivot arm and two second short swing arms, wherein the two second short swing arms are respectively connected to two ends of the second pivot arm, and a length of each of the second short swing arms is less than half of a length of the second pivot arm, and wherein the second pivot arm is pivotally connected to a bottom portion of the second side portion of the keycap, and each of the second short swing arms is swingably connected to the substrate; and a third link member, wherein the third link member is connected between the substrate and the keycap, wherein the third link member comprises a third pivot arm and two third short swing arms, wherein the two third swing arms are respectively connected to two ends of the third pivot arm, and a length of each of the third short swing arms is less than half of a length of the third pivot arm, wherein the third pivot arm is pivotally connected to a bottom portion of the third side portion of the keycap, and an extension direction of the third pivot arm is perpendicular to an extension direction of the first pivot arm or an extension direction of the second pivot arm, and wherein each of the third short swing arms is swingably connected to the substrate; wherein the two first short swing arms of the first link member are respectively adjacent to the third side portion and the fourth side portion of the keycap, and the two second short swing arms of the second link member are respectively adjacent to the third side portion and the fourth side portion of the keycap;

the first link member and the second link member enclose a receiving space, and the third link member is in the receiving space; and one of the two first short swing arms of the first link member adjacent to the third side portion comprises a first indentation, one of the two second short swing arms of the second link member adjacent to the third side portion comprises a second indentation, when the keycap is pressed and is moved downwardly toward the substrate, the two ends of the third pivot arm of the third link member are respectively received in the first indentation and the second indentation.

2. A keyboard device comprising:

a substrate;

a keycap disposed on the substrate, wherein the keycap comprises a first side portion, a second side portion, a third side portion, and a fourth side portion, wherein the first side portion, the second side portion, the third side portion, and the fourth side portion are connected to one another, and wherein the first side portion is opposite to the second side portion, and the third side portion is opposite to the fourth side portion;

a first link member connected between the substrate and the keycap, wherein the first link member comprises a first pivot arm and two first short swing arms, wherein the two first short swing arms are respectively connected to two ends of the first pivot arm, and a length of each of the first short swing arms is less than half of a length of the first pivot arm, and wherein the first pivot arm is pivotally connected to a bottom portion of the first side portion of the keycap, and each of the first short swing arms is swingably connected to the substrate;

a second link member connected between the substrate and the keycap, wherein the second link member comprises a second pivot arm and two second short swing arms, wherein the two second short swing arms are respectively connected to two ends of the second pivot arm, and a length of each of the second short swing arms is less than half of a length of the second pivot arm, and wherein the second pivot arm is pivotally connected to a bottom portion of the second side portion of the keycap, and each of the second short swing arms is swingably connected to the substrate; and a third link member, wherein the third link member is connected between the substrate and the keycap, wherein the third link member comprises a third pivot arm and two third short swing arms, wherein the two third swing arms are respectively connected to two ends of the third pivot arm, and a length of each of the third short swing arms is less than half of a length of the third pivot arm, wherein the third pivot arm is pivotally connected to a bottom portion of the third side portion of the keycap, and an extension direction of the third pivot arm is perpendicular to an extension direction of the first pivot arm or an extension direction of the second pivot arm, and wherein each of the third short swing arms is swingably connected to the substrate; wherein the two first short swing arms of the first link member are respectively adjacent to the third side portion and the fourth side portion of the keycap, and the two second short swing arms of the second link member are respectively adjacent to the third side portion and the fourth side portion of the keycap;

the first link member and the second link member enclose a receiving space, and the third link member is in the receiving space; and one of the two first short swing arms of the first link member adjacent to the third side portion comprises a first indentation, one of the two second short swing arms of the second link member adjacent to the third side portion comprises a second indentation, and at least a portion of the third link member corresponds to the first indentation and the second indentation.

3. The keyboard device according to claim 2, wherein a side portion of the first pivot arm of the first link member facing the second link member comprises a first receding portion, and one of the third short swing arms of the third link member is received in the first receding portion.

4. The keyboard device according to claim 2, wherein two assembling members and a stopping member are on the substrate, wherein the two assembling members are spaced from each other, the stopping member is nearer to the third side portion, as compared with the two assembling members, the two third short swing arms of the third link member are swingably connected to the two assembling members, and the third pivot arm is adjacent to the stopping member.

5. The keyboard device according to claim 2, further comprising a fourth link member, wherein the fourth link member is connected between the substrate and the keycap, wherein the fourth link member comprises a fourth pivot arm and two fourth short swing arms, wherein the two fourth short swing arms are respectively connected to two ends of the fourth pivot arm, and a length of each of the fourth short swing arms is less than half of a length of the fourth pivot arm, wherein the fourth pivot arm is pivotally connected to a bottom portion of the fourth side portion of the keycap, and an extension direction of the fourth pivot arm is perpendicular to the extension direction of the first pivot arm and the extension direction of the second pivot arm, and wherein each of the fourth short swing arms is swingably connected to the substrate.

6. The keyboard device according to claim 5, wherein a resilient member is on the substrate, wherein a side portion of the third pivot arm of the third link member facing the fourth link member comprises an inner receding portion, a side portion of the fourth pivot arm of the fourth link member facing the third link member comprises another inner receding portion, and the resilient member is received in the inner receding portion and the another inner receding portion.

7. The keyboard device according to claim 2, wherein a length of the first side portion or a length of the second side portion is less than a length of the third side portion or a length of the fourth side portion, and wherein a length of each of the first short swing arms of the first link member is less than half of the length of the first side portion or half of the length of the second side portion, a length of each of the second short swing arms of the second link member is less than half of the length of the first side portion or half of the length of the second side portion, and a length of each of the third short swing arms of the third link member is less than half of the length of the first side portion or half of the length of the second side portion.

8. The keyboard device according to claim 7, wherein the substrate has a first alignment portion, a side portion of the third link member adjacent to the substrate has a second alignment portion, and the first alignment portion corresponds to the second alignment portion.

9. The keyboard device according to claim 8, wherein the substrate has a hollowed portion, the first alignment portion is a plate and in the hollowed portion, and the second alignment portion is a recess.

10. A keyboard device comprising:

a substrate;

a keycap disposed on the substrate, wherein the keycap comprises a first side portion, a second side portion, a third side portion, and a fourth side portion, wherein the first side portion, the second side portion, the third side portion, and the fourth side portion are connected to one another, and wherein the first side portion is opposite to the second side portion, and the third side portion is opposite to the fourth side portion;

a first link member connected between the substrate and the keycap, wherein the first link member comprises a first pivot arm and two first short swing arms, wherein the two first short swing arms are respectively connected to two ends of the first pivot arm, and a length of each of the first short swing arms is less than half of a length of the first pivot arm, and wherein the first pivot arm is pivotally connected to a bottom portion of the first side portion of the keycap, and each of the first short swing arms is swingably connected to the substrate;

a second link member connected between the substrate and the keycap, wherein the second link member comprises a second pivot arm and two second short swing arms, wherein the two second short swing arms are respectively connected to two ends of the second pivot arm, and a length of each of the second short swing arms is less than half of a length of the second pivot arm, and wherein the second pivot arm is pivotally connected to a bottom portion of the second side portion of the keycap, and each of the second short swing arms is swingably connected to the substrate; and a third link member, wherein the third link member is connected between the substrate and the keycap, wherein the third link member comprises a third pivot arm and two third short swing arms, wherein the two third swing arms are respectively connected to two ends of the third pivot arm, and a length of each of the third short swing arms is less than half of a length of the third pivot arm, wherein the third pivot arm is pivotally connected to a bottom portion of the third side portion of the keycap, and an extension direction of the third pivot arm is perpendicular to an extension direction of the first pivot arm or an extension direction of the second pivot arm, and wherein each of the third short swing arms is swingably connected to the substrate; wherein a side portion of the first pivot arm of the first link member facing the second link member comprises a first receding portion, and one of the third short swing arms of the third link member is received in the first receding portion; and a first reinforcing block protrudes from the side portion of the first pivot arm of the first link member facing the second link member, and the first receding portion is formed between the first reinforcing block and the first short swing arm adjacent to the third side portion.

11. The keyboard device according to claim 10, wherein a width of the first reinforcing block decreases from the first pivot arm toward the second pivot arm.

* * * * *